United States Patent [19]

Goelzer

[11] Patent Number: 5,009,769

[45] Date of Patent: Apr. 23, 1991

[54] PROCESS FOR CATALYTIC CRACKING OF HYDROCARBONS

[75] Inventor: Alan R. Goelzer, Atkinson, N.H.

[73] Assignee: Stone & Webster Engineering Corporation, Boston, Mass.

[21] Appl. No.: 496,164

[22] Filed: Mar. 19, 1990

Related U.S. Application Data

[63] Continuation of Ser. No. 307,329, Feb. 6, 1989, abandoned.

[51] Int. Cl.[5] ..... C10G 11/18; C10G 51/06

[52] U.S. Cl. ..... 208/113; 208/78; 208/155; 502/43

[58] Field of Search ..... 208/113, 120, 155, 78; 502/43

[56] References Cited

U.S. PATENT DOCUMENTS

| | | | |
|---|---|---|---|
| 2,900,325 | 8/1959 | Rice et al. | 208/78 |
| 3,152,064 | 10/1964 | Osborne | 208/78 |
| 3,305,475 | 2/1967 | Waldby et al. | 208/155 |
| 3,424,672 | 1/1969 | Mitchell | 208/164 |
| 3,448,037 | 6/1969 | Bunn, Jr. et al. | 208/164 |
| 3,617,496 | 11/1971 | Bryson et al. | 208/74 |
| 3,617,497 | 11/1971 | Bryson et al. | 208/120 |
| 3,751,359 | 8/1973 | Bunn, Jr. | 208/155 |
| 3,801,493 | 4/1974 | Youngblood et al. | 208/78 |
| 3,849,291 | 11/1974 | Owen | 208/78 |
| 3,894,934 | 7/1975 | Owen et al. | 208/78 |
| 3,894,935 | 7/1975 | Owen | 288/78 |
| 3,928,172 | 12/1975 | Davis, Jr. et al. | 208/77 |
| 3,993,556 | 11/1976 | Reynolds et al. | 208/155 |
| 4,033,856 | 7/1977 | Colvert et al. | 208/164 |
| 4,033,857 | 7/1977 | Williams et al. | 208/102 |
| 4,331,533 | 5/1982 | Dean et al. | 208/113 |
| 4,332,674 | 6/1982 | Dean et al. | 208/120 |
| 4,336,160 | 6/1982 | Dean et al. | 208/113 |
| 4,434,049 | 2/1984 | Dean et al. | 208/153 |
| 4,556,479 | 12/1985 | Mauleon et al. | 208/164 |
| 4,582,912 | 4/1986 | Saleh et al. | 502/350 |
| 4,601,814 | 7/1986 | Mauleon et al. | 208/113 |
| 4,664,778 | 5/1987 | Reinkemeyer | 208/113 |
| 4,717,466 | 1/1988 | Herbst et al. | 208/113 |
| 4,749,470 | 6/1988 | Herbst et al. | 208/113 |
| 4,780,195 | 10/1988 | Miller | 208/120 |
| 4,786,400 | 11/1988 | Farnsworth | 208/80 |
| 4,828,680 | 5/1989 | Green et al. | 208/120 |

OTHER PUBLICATIONS

Mauleon et al., "Characterization and Selection of Heavy Feeds for Upgrading Through Fluid Catalytic Cracking Process", Twelfth World Petroleum Congress, Houston, Texas (1987).

*Primary Examiner*—Anthony McFarlane

*Attorney, Agent, or Firm*—Hedman, Gibson, Costigan & Hoare

[57] ABSTRACT

An improved process and apparatus is provided for simultaneously, independently catalytically cracking dissimilar hydrocarbon feedstocks at elevated temperatures in separate riser reactors and under respective operating parameters which permit selective conversion to desired products, wherein catalyst regeneration is conducted in two steps comprising separate relatively lower and higher temperature regeneration stages.

5 Claims, 1 Drawing Sheet

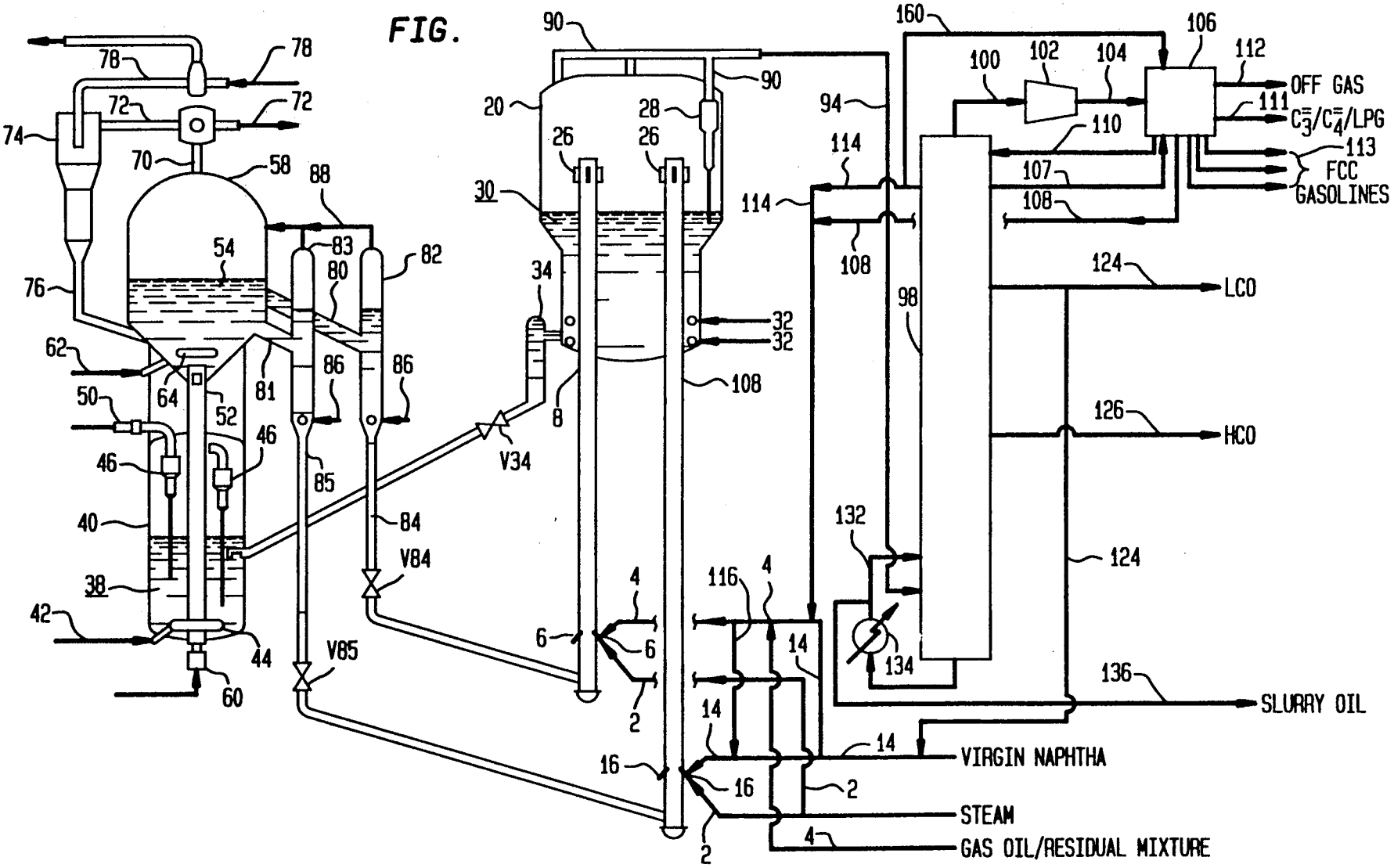
FIG.

PROCESS FOR CATALYTIC CRACKING OF HYDROCARBONS

This application is a continuation of Ser. No. 07/307,329, filed Feb. 6, 1989, now abandoned.

FIELD OF THE INVENTION

The present invention relates to the field of fluidized catalytic cracking of hydrocarbon feedstocks. In particular, this invention relates to an improved process and apparatus for catalytically cracking hydrocarbon feedstocks at elevated temperatures wherein catalyst regeneration is conducted in two steps comprising separate relatively low and high temperature regeneration stages and where feedstocks to said method are controlled to obtain a desired product distribution and improved yields of high octane blending stock, $C_3$–$C_4$ olefins and light cycle oil/distillate. In another aspect, this invention relates to an improved process and apparatus of catalytically cracking hydrocarbon feedstocks which relates catalyst activity and selectivity to processing parameters to improve the conversion of available refinery materials.

BACKGROUND OF THE INVENTION

Combination fluidized catalytic cracking (FCC)-regeneration processes wherein hydrocarbon feedstocks are contacted with a continuously regenerated freely moving finely divided particulate catalyst material under conditions permitting conversion into such useful products as olefins, fuel oils, gasoline and gasoline blending stocks are well known. Such FCC processes for the conversion of high boiling portions of crude oils comprising vacuum gas oils and heavier components customarily referred to as residual oils, reduced crude oils, vacuum resids, atmospheric tower bottoms, topped crudes or simply heavy hydrocarbons and the like have been of much interest in recent years especially as demand has exceeded the availability of more easily cracked light hydrocarbon feedstocks. The cracking of such heavy hydrocarbon feedstocks which comprise very refractory components, e.g. polycyclic aromatics and asphaltenes and the like, capable of depositing relatively large amounts of coke on the catalyst during cracking, and which typically requires severe operating conditions including very high temperatures has presented problems associated with plant construction materials and catalyst impairment.

At present, there are several processes available for fluidized catalytic cracking of such heavy hydrocarbon feedstocks. A particularly successful and much preferred approach which avoids such problems as mentioned above is described, for example, in U.S. Pat. Nos. 4,664,778; 4,601,814; 4,336,160; 4,332,674; and 4,331,533.

In such processes, a combination fluidized catalytic cracking-regeneration operation is provided wherein catalyst regeneration is successively carried out in separate relatively lower and higher temperature regeneration zones each independently operating under selected conditions to provide hot, fully regenerated catalyst with very limited catalyst impairment per catalyst regeneration cycle. Such hot regenerated catalyst is then employed in the high temperature, highly selective catalytic cracking and simultaneous conversion of both high and low boiling components contained in heavy hydrocarbon feeds.

Due to the nature of heavy hydrocarbon feeds, cracking in such FCC processes as described above increases selectivity tending toward light cycle gas-oil and higher boiling materials production. These products are often employed as a component of diesel fuels and furnace oils preferably after hydrotreating or caustic treating. Catalytic cracking of such feeds, however, tends to oppose selectivity to lower boiling components for use as gasoline blending stocks, or as precursors for synthesizing gasoline blending stocks, especially those of higher octane values. It is believed that such competing effects arise in part due to carbon laydown on the catalyst as the catalyst travels through zones in the reactor. As the amount of carbon on the catalyst increases along the reaction path, the gasoline and light olefin selectivity from the heavy feed decreases. The higher the molecular weight of the feed hydrocarbon, the greater the carbon on catalyst competing effect because higher molecular weight components tend to contain more polynuclear aromatic compounds and asphaltenes which yield more coke upon initial cracking and vaporization than other compounds. Of the aromatic compounds, the polynuclear compounds not only crack at a slower rate, but will also have a much higher selectivity to $C_2$ and lighter gases and coke production, while the mono- and di-aromatics and the alkyl side chains of naphthene components tend not only to crack at a faster rate, but also tend to exhibit a higher selectivity to gasoline and desired light olefins such as propylene, butenes, pentenes and hexenes. Therefore, as such heavier hydrocarbon feed undergoes cracking the heavier hydrocarbon feed components should be subjected to a reduced residence time at extremely high temperatures in order to limit the cracking thereof as much as possible to paraffinic side chains and mono- and di-aromatics in general to reduce excessive coke production. Alternatively, gasoline selectivity is optimized by more severe catalytic cracking operations of light hydrocarbon feeds, e.g. higher catalyst-to-oil ratios, longer residence times and relatively higher temperatures, than are desirable in the cracking of heavier feeds.

It often is desirable to operate FCC processes in a manner which maximizes the production of a given product or products, especially in the absence of competing effects such as mentioned above. For example, either one or both of the gasoline/light olefins and light cycle oil products may be desired in order to produce large quantities of high octane gasoline and gasoline precursors while simultaneously producing increased quantities of fuel oil distillates and diesel fuel. This is especially so in light of current environmental concerns which have necessitated a reduction in pollution byproducts of combustion from automobiles from the use of leaded gasoline products. Therefore, unleaded gasoline blend stocks having a high octane number are much in demand. It would, therefore, be desirable to expand the operating envelope of such useful process as described above to increased selectivity to high octane material and light olefins while simultaneously selectively catalytically cracking economical heavy hydrocarbon feeds to heavy naphtha, and distillates or light and heavy cycle oils and higher boiling materials.

There are a number of ways of accomplishing these goals. The method described in U.S. Pat. No. 3,617,497 discloses segregating hydrocarbon feed and charging the relatively lower molecular weight feed fraction or fractions near the bottom of an elongated riser reaction zone and the relatively higher molecular weight feed fraction or fractions progressively further up the riser. Cracking of the lighter hydrocarbon feed in the absence of heavy hydrocarbon feed is thus accomplished on a low carbon content catalyst to maximize gasoline selectivity. Although feed residence times can be established in such a process by controlling the total charge rate of hydrocarbon to the riser, catalyst-to-oil ratios and reaction temperatures are difficult to optimize for maximum gasoline and light cycle oil selectivity, respectively.

A more versatile method for optimizing cracking selectivity from relatively lower and higher boiling feeds is described by U.S. Pat. No. 3,617,496. In such a process, cracking selectivity to gasoline production is improved by fractionating the feed hydrocarbon into relatively lower and higher molecular weight fractions capable of being cracked to gasoline and charging said fractions to separate riser reactors. In this manner, the relatively light and heavy hydrocarbon feed fractions are cracked in separate risers in the absence of each other, permitting the operation of the lighter hydrocarbon riser under conditions favoring gasoline selectivity, e.g. eliminating heavy carbon laydown, convenient control of hydrocarbon feed residence times, and convenient control of the weight ratio of catalyst to hydrocarbon feed therein thereby affecting variations in individual reactor temperatures.

Other processes which similarly employ the use of two or more separate riser reactors to crack disimilar hydrocarbon feeds are described, for example, in U.S. Pat. No. 3,993,556 (cracking heavy and light gas oils in separate risers to obtain improved yields of naphtha at higher octane ratings); U.S. Pat. No. 3,928,172 (cracking a gas oil boiling range feed and heavy naphtha and/or virgin naphtha fraction in separate cracking zones to recover high volatility gasoline, high octane blending stock, light olefins for alkylation reactions and the like); U.S. Pat. No. 3,894,935 (catalytic cracking of heavy hydrocarbons, e.g. gas oil, residual material and the like, and a $C_3$–$C_4$ rich fraction in separate conversion zones); U.S. Pat. No. 3,801,493 (cracking virgin gas oil, topped crude and the like, and slack wax in separate risers to recover, inter alia, a light cycle gas oil fraction for use in furnace oil and a high octane naphtha fraction suitable for use in motor fuel, respectively); U.S. Pat. No. 3,751,359 (cracking virgin gas oil and intermediate cycle gas oil recycle in separate respective feed and recycle risers); U.S. Pat. No. 3,448,037 (wherein a virgin gas oil and a cracked cycle gas oil, e.g. intermediate cycle gas oil, are individually cracked through separate elongated reaction zones to recover higher gasoline products); U.S. Pat. No. 3,424,672 (cracking topped crude and low octane light reformed gasoline in separate risers to increase gasoline boiling range product); and U.S. Pat. No. 2,900,325 (cracking a heavy gas oil, e.g. gas oils, residual oils and the like, in a first reaction zone, and cracking the same feed or a different feed, e.g. a cycle oil, in a second reaction zone operated under different conditions to produce high octane gasoline).

SUMMARY OF THE INVENTION

It is therefore an object of the present invention to provide an improved process and apparatus for catalytically cracking hydrocarbon feedstocks at elevated temperatures wherein catalyst regeneration is conducted in two or more steps comprising separate relatively higher and lower temperature regeneration stages.

It is a further object of this invention to provide such a process wherein feedstocks thereto are controlled to obtain a desired product distribution and improved yields of high octane gasoline blending stock and light olefins.

It is still another object of this invention to provide an improved process and apparatus of catalytically cracking hydrocarbon feedstocks at elevated temperatures which relates catalyst activity and selectivity to processing parameters of individual heavy hydrocarbon and naphtha boiling range material to improve the selective conversion thereof to light cycle gas oils and said gasoline blending stocks and light olefins, respectively.

Additional objects of the present invention will become apparent from the following description.

To this end, the present invention provides an improved combination fluidized catalytic cracking-regeneration process for cracking hydrocarbon feedstocks or vapors thereof with a cracking catalyst comprising separate first and second catalyst regeneration zones, said catalyst being continuously regenerated in said first and second regeneration zones, successively, by combusting hydrocarbonaceous deposits on the catalyst in the presence of an oxygen-containing gas under conditions effective to produce a first regeneration zone flue gas relatively rich in carbon monoxide and a second regeneration zone flue gas relatively rich in carbon dioxide, wherein temperatures in the first regeneration zone range from about 1100° F. to about 1300° F., and temperatures in the second regeneration zone range from about 1300° F. up to about 1800° F.

The improvement in said process comprises (a) cracking a first hydrocarbon feed comprising a gas-oil or residual oil, or mixture thereof, boiling range material in a first elongated riser reactor in the presence of a regenerated cracking catalyst supplied from the second catalyst regeneration zone at temperatures ranging from 1300° F. up to 1800° F., catalyst-to-oil ratios of from 5 to 10, and nominal residence times of from 1 to 4 seconds, and where coke is deposited on said catalyst in an amount less than 1.2 weight percent thereof, to obtain vaporous conversion products of said first hydrocarbon feed comprising a heavy naphtha fraction and materials lower boiling than said heavy naphtha fraction, light and heavy cycle gas oil fractions, and materials higher boiling than said heavy cycle gas oil. While cracking the first hydrocarbon feed in the manner described above, a second hydrocarbon feed comprising virgin, intermediate or heavy FCC naphtha boiling range material or a mixture thereof, is simultaneously cracked in a second elongated riser reactor in the presence of a regenerated cracking catalyst supplied from the second regeneration zone at temperatures of from 1300° F. up to 1800° F., catalyst-to-oil ratios of from 3 to 12, and residence times of from 1 to 5 seconds and where coke is deposited on said catalyst in an amount less than 0.5 weight percent thereof, to obtain vaporous conversion products of said second hydrocarbon feed comprising gasoline boiling range material having high octane numbers and lower boiling range material which is mostly olefinic in nature. The vaporous conversion products from the first and second elongated riser reactors are then combined in a disengaging space thereby separating entrained catalyst particles from vaporous product material which is then passed to a fractional distillation zone for separation into respective products.

As will be appreciated by those skilled in the art, a major advantage provided by the present invention is the flexibility to simultaneously select operating conditions specifically suited to achieve the optimum desired conversion of available refinery materials and selected hydrocarbon feedstocks to desired products. In particular, the novel arrangement of apparatus and processing concepts of this invention, as more fully discussed below, substantially obviates problems related to high regenerator and catalyst temperatures encountered in catalytic cracking of high boiling hydrocarbon feedstocks, generally referred to as heavy hydrocarbons herein and boiling initially at least 400° F. or higher, to produce gasoline and lower and higher boiling hydrocarbon components. Thus conditions favorable for cracking such feedstocks can be encouraged in a respective riser reactor. Moreover, severe conditions needed for selectively causing the desired cracking reactions of naphtha boiling range feedstocks in a respective riser reactor to high octane gasolines in addition to light olefins, useful as gasoline precursors via, for example, alkylation can be encouraged. Advantage can be taken of increased reaction temperatures, increased catalyst-to-oil ratios and extended hydrocarbon vapor residence time in contact with the catalyst and unit operating pressure.

The process and apparatus of the present invention will be better understood by reference to the following detailed discussion of specific embodiments and the attached FIGURE which illustrates and exemplifies such embodiments. It is to be understood, however, that such illustrated embodiments are not intended to restrict the present invention, since many more modifications may be made within the scope of the claims without departing from the spirit thereof.

DESCRIPTION OF THE DRAWING

The FIGURE is an elevational schematic of the process and apparatus of the present invention shown in a combination fluidized catalytic cracking-regeneration operation wherein two respective riser reactors are provided for independently catalytically cracking heavy hydrocarbon feeds and lighter naphtha feeds, wherein catalyst regeneration is successively conducted in two separate relatively lower and higher temperature zones.

DETAILED DISCUSSION OF SPECIFIC EMBODIMENTS OF THE INVENTION

The catalytic cracking process of this invention relates to the cracking of economically obtained heavy hydrocarbon feedstocks generally referred to as gas oils, residual oils, gas oils comprising residual components, reduced crude, topped crude, and high boiling residual hydrocarbons comprising metallo-organic compounds and the like. These are among several terms used in the art to describe portions of crude oil such as a gas oil with or without a higher boiling hydrocarbon feed portion which may comprise metallo-organic compounds, and essentially all other heavy hydrocarbon feedstocks having a Conradson carbon of at least 2 weight percent and boiling initially at least 400° F., with approximately 20 weight percent or more of the components therein boiling at about 1000° F. or above.

Products obtained from cracking such feedstocks include but are not limited to gasoline and gasoline boiling range products boiling from $C_5$ to 425° F., light cycle oil boiling in the range from 425° F. to 600°/670° F., a heavy cycle oil product inclusive of product higher boiling than light cycle oil and boiling up to 800° F. and above, and a slurry oil boiling from about 670° F. up to 970° F. Additionally, a heavy cracked naphtha is produced and drawn down as the front end of the light cycle oil distillate or produced separately, and which boils in the range from 330° F. to 425° F.

The process of this invention also relates to the cracking of light, heavy and intermediate virgin naphthas boiling in the range from 10° F. to 450° F. and heavy FCC naphthas boiling in the range from 150° F. to 425° F., to produce, among other things, high octane gasoline, light olefins for alkylation or other reactions to produce high octane blending stock or for petrochemical manufacture, and a common light cycle oil stream.

The heavy hydrocarbon feedstock typically comprising a mixture of vacuum gas oils and residual oils is introduced into a first elongated riser reactor and mixed therein with a highly active freshly regenerated cracking catalyst at a temperature at least above about 1300° F. The hydrocarbon feed is preferably first mixed with steam on other gas at such temperature and conditions as to form a highly atomized feedstream, which is then mixed with the hot regenerated catalyst to form a generally vaporous hydrocarbon-catalyst suspension. After catalytic conversion of hydrocarbon feed material, a suspension separation device or disengaging vessel arrangement containing, for example, separator cyclones employed at the riser discharge separates entrained catalyst from vaporous hydrocarbons feed material including cracked products of conversion.

Simultaneously or separately with that operation above, a naphtha feed is introduced into a second elongated riser reactor under conditions to obtain mixing therein with hot freshly regenerated cracking catalyst at a temperature at least above 1300° F. and under conditions so as to form a vaporous hydrocarbon-catalyst suspension which after catalytic conversion of naphtha feed material flows from the riser discharge into the disengagement device to separate entrained catalyst from vaporous material and additional cracked products of conversion.

The combined vaporous hydrocarbon products leaving the separator cyclones are then separated in a downstream fractionation column to products more fully discussed hereinbelow. The spent catalyst particles recovered from each respective riser reactor in the cracking operation are thereafter stripped of entrained hydrocarbon material via treatment with steam or some other suitable stripping gas at an elevated temperature in the range of about 880° F. to about 1050° F., and then successively passed to first and second (relatively lower and higher temperature) catalyst regeneration zones, such as fully described, for example, in U.S. Pat. Nos. 4,664,778, 4,601,814; 4,336,160; 4,332,674; and 4,331,533 which are incorporated herein by reference.

Generally, in such processes, the stripped spent catalyst is passed to a dense fluid bed of catalyst in a first catalyst regeneration zone maintained under oxygen and temperature restricted conditions below about 1300° F., and preferably not above about 1260° F. Combustion of hydrocarbonaceous material or coke deposited on the spent catalyst in the first regeneration zone is conducted at relatively mild temperatures and conditions sufficient to burn substantially all the hydrogen present in the coke deposits and a portion of the carbon. The regenerator temperature is thus preferably restricted to a temperature and conditions which do not accelerate catalyst deactivation by exceeding the hydrothermal stability of the catalyst or the metallurgical limits of a conventional low temperature regenerator operation. Flue gases relatively rich in carbon monoxide are recovered from the first regenerator zone and can be directed, for example, to a carbon monoxide boiler or incinerator and flue gas cooler to generate steam by promoting a more complete combustion of available carbon monoxide therein, prior to combination with other process flue gas streams. Such combined streams can then be passed through a power recovery prime mover section to generate process compressed air in the manner set forth in copending U.S. patent application Ser. No. 07/273,266, filed Nov. 18, 1988, which is incorporated herein by reference.

A partially regenerated catalyst of limited temperature and comprising carbon residue is recovered from the first regenerator zone substantially free of hydrogen in the coke, and is passed to a second separate unrestrained higher temperature catalyst regeneration zone wherein the remaining relatively carbon-rich coke deposits are substantially completely burned to carbon dioxide at an elevated catalyst temperature preferably within the range of 1300° F. to to 1600° F., and possibly up to 1800° F., in an environment with minimal steam from combustion of water or other sources.

The second regeneration zone is designed to limit catalyst residence time therein at the high temperature while attaining a carbon burning rate required to achieve a residual carbon on recycled hot catalyst particles less than about 0.05 weight percent and more preferably less than about 0.03 weight percent.

Hot flue gases obtained from the second regeneration zone can be fed to external cyclones for recovery of entrained catalyst fines before further utilization, for example, in combining with the prior combusted first regeneration zone flue gas in the manner set forth above.

The hot fully regenerated catalyst particles are then passed through respective catalyst collecting zones and conduits to the first and second riser reactors for further cracking operation in the manner described hereinabove.

The subject apparatus to carry out the process of this invention is thus a combination catalyst-regeneration operation comprising separate first and second, relatively lower and higher temperature, catalyst regeneration zones operated under conditions such as described above, thereby supplying hot regenerated catalyst to first and second elongated riser reactors for independently catalytically cracking respective hydrocarbon feeds under operating parameters permitting selective conversion to desired products. A fractional distillation zone is also provided for receiving the cracked product mixture from said first and second riser reactors to separate products therein.

Referring now to the FIGURE, there is shown an apparatus adapted for performing a preferred embodiment of the process of the present invention. Accordingly, first and second elongated hydrocarbon riser reactors 8 and 108, respectively, are provided wherein a fresh high boiling heavy hydrocarbon feed to be catalytically cracked, typically comprising a gas oil or residual oil or a mixture thereof, is introduced into a lower portion of first riser reactor 8 by conduit means 4 through a multiplicity of streams in the riser cross section charged through a plurality of horizontally spaced apart feed injection nozzles indicated by injection nozzle 6. Such nozzles are preferably atomizing feed injection nozzles of the type described, for example, in U.S. Pat. No. 4,434,049 which is incorporated herein by reference, or some other suitably high energy injection source. Steam, fuel gas, carbon dioxide or some other suitable gas can be introduced into the feed injection nozzles through conduit means 2 as an aerating, fluidizing or diluent medium to facilitate atomization or vaporization of the hydrocarbon feed.

Hot regenerated catalyst is introduced into the riser reactor 8 lower portion by conduit means 10 and caused to flow upwardly and become commingled with the multiplicity of hydrocarbon feed streams in the riser reactor 8 cross section, and in an amount sufficient to form a high temperature vaporized mixture or suspension with the hydrocarbon feed. The high temperature suspension thus formed and comprising hydrocarbons, diluent, fluidizing gas and the like and suspended (fluidized) catalyst thereafter passes through riser 8 which is operated in a manner known to those skilled in the art.

Cracking conditions in riser 8 to produce cracked products comprising light olefins, cracked gasoline and heavier cracked oils from the high boiling component heavy feed are well known. The heavy feed comprising high molecular weight components tends to contain an appreciable amount of polynuclear aromatic compounds which yield more coke on cracking than other compounds, and which crack with lower selectivity to desired products but greater selectively to $C_2$ and lighter gases and coke. Thus the heavier hydrocarbon feed components are preferably subjected to relatively reduced residence times at higher temperatures in order to obtain high octane gasoline and light cycle oil yields, and the operation terminated before appreciable cracking or condensation of polyaromatics occur therein producing excessive coke formation, and extra $C_2$ and lighter gases. Cracking conditions preferably include nominal residence times of from 1 to 4 seconds, with a riser temperature profile of regenerated catalyst temperatures from 1300° F. to 1600° F., feed preheat temperatures from 250° F. to 750° F., mix-zone outlet temperatures from 1000° F. to 1100° F., catalytic zone inlet temperatures from 900° F. to 1100° F., and riser reactor outlet temperatures from 870° F. to 1030° F., and riser pressures ranging from 15 to 40 psig. Catalyst-to-oil ratios based on total feed can range from 5 to 10, with coke on regenerated catalyst ranging from 0.3 to 1.2 weight percent. The amount of diluent added through conduit means 2 can vary depending upon the ratio of hydrocarbon to diluent desired for control purposes. If, for example, steam is employed as a diluent, it can be present in an amount of from about 2 to 8 percent by weight based on the hydrocarbon charge.

First riser reactor 8 effluent comprising a mixture of vaporized hydrocarbon and suspended catalyst particles including cracked products of catalytic conversion passes from the upper end of riser 8 through discharge through an initial separation in a suspension separator means indicated by 26 such as an inertial separator and/or passed to one or more cyclone separators 28 located in the upper portion of vessel 20 for additional separation of volatile hydrocarbons from catalyst particles. Separated vaporous hydrocarbons, diluent, stripping gasiform material and the like is withdrawn by conduit 90 for passage to product recovery equipment more fully discussed hereinbelow.

Spent catalyst from the cracking process separated by means 26 and cyclones 28 and having a hydrocarbonaceous product or coke from heavy hydrocarbon cracking and metal contaminants deposited thereon is collected as a bed of catalyst 30 in a lower portion of vessel 20. Stripping gas such as steam is introduced to the lower bottom portion of the bed by conduit means 32. Stripped catalyst is passed from vessel 20 into catalyst holding vessel 34, through flow control valve $V_{34}$ and conduit means 36 to a bed of catalyst 38 being regenerated in vessel 40, the first catalyst regeneration zone. Oxygen-containing regeneration gas such as air is introduced to a bottom portion of bed 38 by conduit means 42 communicating with air distributor ring 44. Regeneration zone 40 as operated in accordance with procedures known in the art is maintained under conditions as a relatively low temperature regeneration operation generally below 1300° F. and preferably below 1260° F. and under conditions selected to achieve at least a partial combustion and removal of carbon deposits and substantially all of the hydrogen associated with the deposited hydrocarbons material from catalytic cracking. The combustion accomplished in the first regeneration zone 40 is thus accomplished under such conditions to form a carbon monoxide rich first regeneration zone flue gas stream. Said flue gas stream is separated from entrained catalyst fines by one or more cyclone separating means, such as indicated by 46. Catalyst thus separated from the carbon monoxide rich flue gases by the cyclones is returned to the catalyst bed 38 by appropriate diplegs. Carbon monoxide rich flue gases recovered from the cyclone separating means 46 in the first regeneration zone by conduit means 50 can be directed, for example, to a carbon monoxide boiler or incinerator and/or a flue gas cooler (both not shown) to generate steam by a more complete combustion of available carbon monoxide therein, prior to combination with other process flue gas streams and passage thereof through a power recovery prime mover section, in the manner discussed hereinabove. In the first regeneration zone it is therefore intended that the regeneration conditions are selected such that the catalyst is only partly regenerated in the removal of hydrocarbonaceous deposits therefrom such that sufficient residual carbon remains on the catalyst to achieve higher catalyst particle temperatures above 1400° F., preferably up to about 1600° F., and up to 1800° F. as required upon more complete removal of the carbon from catalyst particles by combustion thereof with excess oxygen-containing regeneration gas in a second catalyst regeneration zone discussed hereinbelow.

Partially regenerated catalyst now substantially free of hydrogen in residual carbon deposits on the catalyst, is withdrawn from a lower portion of bed 38 for transfer upwardly through riser 52 to discharge into the lower portion of a dense fluid bed of catalyst 54 in an upper separate second catalyst regeneration zone 58. Lift gas such as compressed air is charged to the bottom inlet of riser 52 by a hollow stemplug valve 60 comprising flow control means (not shown).

Conditions in the second catalyst regeneration zone are operated in a manner known in the art to accomplish substantially complete carbon burning removal from the catalyst not removed in the first regeneration zone. Accordingly, regeneration gas such as air or oxygen enriched gas is charged to bed 54 by conduit means 62 communicating with an air distributor ring 64. As shown in the FIGURE, vessel 58 in the second regeneration zone is substantially free of exposed metal internals and separating cyclones such that the high temperature regeneration desired may be effected without posing temperature problems associated with materials of construction. The second catalyst regeneration zone is usually a refractory lined vessel or manufactured from some other suitable thermally stable material known in the art wherein high temperature regeneration of catalyst is accomplished in the absence of hydrogen or formed steam, and in the presence of sufficient oxygen to effect substantially complete combustion of carbon monoxide in the dense catalyst bed 56 to form a carbon dioxide rich flue gas. Thus, temperature conditions and oxygen concentration may be unrestrained and allowed to exceed 1600° F. and possibly reach as high as 1800° F. or as required to substantially complete carbon combustion. However, temperatures are typically maintained between 1300° F. and 1600° F.

In this catalyst regeneration environment residual carbon deposits remaining on the catalyst following the first temperature restrained regeneration zone are substantially completely removed in the second unrestrained temperature regeneration zone. The temperature in vessel 58 in the second regeneration zone is thus not particularly restricted to an upper level except as possibly limited by the amount of carbon to be removed therewithin and heat balance restrictions of the catalytic cracking-regeneration operation. If desired, the second regeneration zone 58 can be provided with a means (not shown) for removing heat from the regenerator therein enabling a lower regenerator temperature as desired to control such heat balance restrictions. Examples of heat removal means which are preferred include controllable catalyst coolers such as described in U.S. Pat. Nos. 2,970,117 and 4,064,039. In such preferred means, a portion of the catalyst in the regenerator is withdrawn from a lower port thereof, passed downwardly out of the regenerator, then lifted, for example, with air as a fluidized bed through an indirect water cooler steam generator, then lifted into an upper port of the regenerator. If desired, the cooled catalyst can alternatively be reintroduced into a lower port of the regenerator. Depending upon the coke forming tendencies of the heavy hydrocarbon feeds to be processed, e.g. the Conradson carbon residue values of the feedstocks, the cooler can be sized accordingly.

As described above, sufficient oxygen is charged to vessel 58 in amounts supporting combustion of the residual carbon on catalyst and to produce a relatively carbon dioxide-rich flue gas with traces of carbon monoxide present.

The $CO_2$-rich flue gas thus generated passes with some entrained catalyst particles from the dense fluid catalyst bed 54 into a more dispersed catalyst phase thereabove from which the flue gas is withdrawn by one or more conduits represented by 70 and 72 communicating with one or more cyclone separators indicated by 74. Catalyst particles thus separated from the hot flue gases in the cyclones are passed by dipleg means 76 to the bed of catalyst 54 in the second regeneration zone 58. $CO_2$-rich flue gases absent catalyst fines and combustion supporting amounts of CO are recovered by one or more conduits represented by 78 from cyclones 74 for use, for example, as described hereinabove in combination with the first regeneration zone flue gases.

Catalyst particles regenerated in zone 58 at a high temperature are withdrawn by refractory lined conduits 80 and 81 for passage to collection vessels 82 and 83, respectively, and thence by conduits 84 and 85 through flow control valves $V_{84}$ and $V_{85}$ to conduits 10 and 12 communicating with respective riser reactor 8 as above discussed, and with a second riser reactor 108 more fully discussed hereinbelow. Aerating gas can be introduced into a lower portion of vessels 82 and 83 by conduit means 86 communicating with a distributor ring within said vessels. Gaseous material withdrawn from the top portion of vessels 82 and 83 by conduit means 88 passes into the upper dispersed catalyst phase of vessel 58.

Simultaneously with the heavy hydrocarbon feed cracking operation described hereinabove, a naphtha feed stream to be catalytically cracked, e.g., light, intermediate or heavy virgin naphtha along with selected cracked naphthas if desired, is introduced into a lower portion of the second elongated riser reactor 108 by conduit means 14 through a multiplicity of streams in the riser cross section charged through a plurality of horizontally spaced apart feed injection nozzles indicated by 16. Such nozzles are preferably atomizing feed injection nozzles or similar high energy injection nozzles of the type described hereinabove.

As in first riser reactor 8, hot freshly regenerated catalyst is introduced into the riser reactor 108 lower portion by conduit means 12 and caused to flow upwardly and become commingled with the multiplicity of hydrocarbon feed streams in the riser reactor 108 cross section, and in an amount sufficient to form a high temperature vaporized mixture or suspension with the hydrocarbon feed. Also as in first riser reactor 8, steam, fuel gas or some other suitable gas can be introduced into the feed injection nozzles through conduit means 2 to facilitate atomization and/or vaporization of the hydrocarbon feed, or as an aerating, fluidizing or diluent medium. The high temperature suspension thus formed and comprising hydrocarbons, diluent, fluidizing gas and the like, and suspended (fluidized) catalyst thereafter passes through riser 108 which is preferably operated independently from the first riser reactor 8 in a manner to selectively catalytically crack relatively low boiling naphthas to desired products, including high octane gasoline and gasoline precursors, and light olefins.

Such cracking conditions in second riser reactor 108 to selectively produce desired cracked products from the naphtha feeds are well known. For example, it is known that heavy carbon laydown on the catalyst, e.g. hydrocarbonaceous material or coke build up (which can be liberally contributed by heavy feed residual oils and the like) is a greater detriment to gasoline selectivity when cracking a relatively low boiling feed, such as virgin naphthas or heavy cracked naphthas, than with cracking a relatively high boiling feed, e.g. residual oil and the like, although it can be a detriment to both. Therefore, a net advantage in terms of gasoline selectivity is achieved by permitting the low molecular weight feed to undergo cracking in the second riser reactor 108 independent of first riser reactor 8 and in the absence of the heavy feed and substantial coke laydown. It is also known that heavy feed undergoes cracking at lower selectivity to gasoline and gasoline precursors than lighter hydrocarbon feeds. Thus, as mentioned hereinabove, it is advantageous to first subject heavier hydrocarbon feed components to reduced residence times and very high temperatures to limit the cracking as much as possible to paraffinic side chains and mono- and diaromatics in general in the first riser reactor 8 to control excessive coke build up, while simultaneously and independently increasing the severity of cracking naphtha feeds in the operation of second riser reactor 108 under the combined influence of such variables as longer residence times, and higher catalyst-to-oil ratios thereby increasing mix zone outlet and catalytic zone inlet temperatures in the presence of low carbon on catalyst effects mentioned hereinabove. Moreover, by employing separate riser reactors 8 and 108 to optimize feed conversion as desired. It will be therefore appreciated that such carbon on catalyst effects and diluent effects described hereinabove are independent and can be manipulated in an advantageous manner in the process of the present invention to cooperate and enhance gasoline selectivity in the overall system.

Thus, in accordance with the process and novel arrangement of apparatus of this invention as shown above, it is possible to select optimal operating conditions in the second riser reactor 108 substantially independent of first riser reactor 8 which conditions are specifically suited to catalytically crack naphtha feed therein providing increased recovery of desired high octane gasoline products, and light olefins while simultaneously operating the first riser reactor under the aforementioned conditions favorable for optimal conversion of heavy high boiling feeds to gasoline and light cycle oil boiling range material.

It is also known that increased catalytic conversion of virgin and cracked naphthas provides products with increased octane numbers plus large yields of light olefins such as butenes and propylene, which are valuable petrochemical dimerization and alkylation charge stocks, and that high temperature recracking of cracking FCC gasoline components also improves octane numbers. Such conversion to the desired products increases with increasing conversion temperatures. Thus, it will be appreciated by those skilled in the art that the process and novel arrangement of apparatus in the present invention in addition to providing selective control of optimal cracking conditions of specific feeds, also provides extremely high cracking temperature capability made possible by the use of first and second catalyst regeneration zones favorable for high temperature cracking and increased conversion of naphtha feeds to such desired products as mentioned above.

In accordance with that above, naphtha is preferably catalytically cracked in second riser 108 under conditions involving nominal residence times of from 1 to 10 seconds, with feed preheat temperatures from 220° F. to 700° F., riser reactor mix zone outlet temperatures from 102° F. to 1200° F., riser reactor catalytic zone inlet temperatures from 980° F. to 1200° F. and riser reactor outlet temperatures from 950° F. to 1050° F., with riser pressures ranging from 15 to 35 psig. Catalyst-to-oil ratios in the second riser reactor based on total feed can range from 3 to 12 with coke make on regenerated catalyst ranging from 0.1 to 0.5 weight percent.

Effluent from the second riser reactor 108 therein comprising a vaporized hydrocarbon-catalyst suspension including catalytically cracked products of naphtha conversion passes from the upper end of riser 108 through dicharge through an initial separation in a suspension separator means indicated by 26 such as described hereinabove and/or passed to one or more cyclone separators 28 located in the upper portion of vessel 20 for additional separation of volatile hydrocarbons from catalyst particles, also as described above. Separated vaporous hydrocarbons, diluent, stripping gasiform material and the like can be withdrawn by conduit 90 for combination with such material from the cracking operation in riser reactor 8, and for passage to product recovery equipment.

Spent catalyst from the cracking process in riser reactor 108 and separated by means 26 and cyclones 28 is collected in catalyst bed 30 and thence regenerated in the manner described hereinabove in the first and second regeneration zones.

The mixture comprising separated vaporous hydrocarbons and materials from hydrocarbon cracking from the cracking operations in riser reactors 8 and 108 is withdrawn by conduit means 90 and transfer conduit means 94 to the lower portion of a main fractional distillation column 98 wherein product vapor can be fractionated into a plurality of desired component fractions. From the top portion of column 98, a gas fraction can be withdrawn via conduit means 100 for passage to a "wet gas" compressor 102 and subsequently through conduit 104 to a gas separation plant 106. A light liquid fraction comprising FCC naphtha and lighter $C_3$–$C_6$ olefinic material is also withdrawn from a top portion of column 98 via conduit means 107 for passage to gas separation plant 106. Liquid condensate boiling in the range of $C_5$-430° F. can be withdrawn from gas separation plant 106 by conduit means 110 for passage of a portion thereof back to the main fractional distillation column 98 as reflux to maintain a desired end boiling point of the naphtha product fraction in the range of about 400° F.–430° F.

Products produced in the gas separation plant 106 comprise a $C_3/C_4$ light olefin LPG fraction which can be passed via conduit means 111 for further processing into ethylene and propylene in processing means not shown, including an off gas comprising lighter boiling material withdrawn in conduit means 112; a light FCC gasoline product boiling up to about 180° F.; an intermediate FCC gasoline product boiling in the range from 100° F. to about 310° F.; and a heavy FCC gasoline boiling in the range from 310° F. to about 430° F., which can be withdrawn, generally, in conduit means 113.

A pump around conduit means 114 in communication with the upper portion of column 98 is provided for supplying at least a portion of a heavy FCC naphtha stream via conduit means 4, 116 and 14 to the feed injection nozzles 16 of the second riser reactor 108 where it is combined with the hot regenerated catalyst introduced by conduit 12 to form a suspension in the manner set forth hereinabove. Heavy FCC naphtha can thus be recycled and recracked in such manner in the presence of the virgin naphtha feed introduced by conduit means 14 to simultaneously catalytically crack both virgin and heavy FCC naphthas under optimum conditions selective for producing high octane gasoline and gasoline feedstocks. In such an arrangement, it is also contemplated cracking heavy FCC naphtha recycle in riser 108 as described above alone or in combination with virgin naphtha.

The heavy FCC naphtha may also be passed all or in part via conduit means 114 and 4 to feed injection nozzle 6 of the first riser reactor 8 where it is combined with the hot regenerated catalyst introduced by conduit means 10 to form a suspension in the presence of the heavy hydrocarbon feed for catalytic recracking in combination with cracking said heavy hydrocarbon feed and to optimize a desired product distribution.

Further, in such an arrangement of the present invention it is contemplated passing virgin naphtha feed through feed conduits 14 to conduit 4 and thence to feed injection nozzle 6 of the first riser reactor 8 and catalytically cracking virgin naphtha in combination with cracking heavy hydrocarbon feed introduced by conduit 4.

The process and apparatus of the present invention also contemplates providing materials lighter and lower boiling than heavy FCC naptha to be catalytically recracked alone or in combination with recycled heavy FCC naphtha, virgin naphtha and/or heavy gas oil/residual hydrocarbon feeds. Such material includes selected FCC gasoline cuts which can be withdrawn from the gas plant 106 via conduit means 108 and 114, and thereafter supplied to conduit means 4 and/or 14 for introduction into feed nozzles 6 and 16 of the first and second riser reactors, respectively, for such catalytic recracking.

A portion of the heavy FCC naphtha stream can also be passed through conduit means 114 to conduit means 160 as a lean oil material for gas generation plant 106.

A light cycle gas oil (LCO)/distillate fraction containing naphtha boiling range hydrocarbons is withdrawn from column 98 through conduit means 124, said LCO/distillate fraction having an initial boiling point in the range of about 300° F. to about 430° F., and an end point of about 600° F. to 670° F. The LCO/distillate fraction can be further processed in a stripper vessel (not shown) within which said LCO/distillate fraction is contacted with stripping vapors thereby stripping the lighter naphtha components from said fraction, and producing a stripped LCO/distillate stream which can thereafter be passed to a hydrotreater or other appropriate processing means for conversion into diesel blending stock. Stripped vapors therefrom comprising naphtha boiling range material can be passed by means (not shown) from said stripper vessel back to the main product fractionator.

It is also contemplated in the process and apparatus of the present invention of passing a portion of the thus produced LCO/distillate via conduit means 124 to conduit 14 to be used in conjunction with other naphtha and heavy hydrocarbon feed streams described hereinabove to optimize a desired product distribution.

A non-distillate heavy cycle gas oil (HCO) fraction having an initial boiling range of about 600° F. to about 670° F. is withdrawn from column 98 at an intermediate point thereof, lower than said LCO/distillate fraction draw point, via conduit means 126. Although not indicated in the FIGURE, at least a portion of the HCO stream can be passed to conduit 4 for recracking in riser reactor 8 in the manner herein provided.

From the bottom portion of column 98, a slurry oil containing non-distillate HCO boiling material is withdrawn via conduit means 132 at a temperature of about 600° F. to 700° F. A portion of said slurry oil can be passed from conduit 132 through a waste heat steam generator 134 wherein said portion of slurry oil is cooled to a temperature of about 450° F. From the waste heat steam generator 134, the cooled slurry oil flows as an additional reflux to the lower portion of column 98. A second portion of the thus produced slurry oil withdrawn via conduit 136 flows as product slurry oil.

It will be apparent to those persons skilled in the art that the apparatus and process of the present invention is applicable in any conformation of combination fluidized catalytic cracking-regeneration processes employing first and second (respectively lower and higher temperature) catalyst regeneration zones. For example, in addition to the "stacked" regeneration zones described in the embodiment of FIG. 1, a "side-by-side"

catalyst regeneration zone configuration which is described, for example, in U.S. Pat. Nos. 4,601,814; 4,336,160 and 4,332,672 may be employed herein.

I claim:

1. In a fluidized catalytic cracking-regeneration process for cracking hydrocarbon feedstocks or the vapors thereof with a cracking catalyst consisting of separate first and second catalyst regeneration zones, wherein said catalyst is regenerated in said first and second regeneration zones, successively, by combusting hydrocarbonaceous deposits on the catalyst in the presence of an oxygen-containing gas under conditions effective to produce a first regeneration zone flue gas rich in carbons monoxide and a second regeneration zone flue gas rich in carbon dioxide, wherein temperatures in the first regeneration zone range from about 1100° F. to about 1300° F., and temperatures in the second regeneration zone range from about 1300° F. to about 1800° F., wherein the improvement consists of:

(a) cracking a first hydrocarbon feed comprising gas oil, residual oil boiling range material or mixtures thereof in a first elongated riser reactor in the presence of regenerated cracking catalyst supplied from the second catalyst regeneration zone at a temperature of at least 1300° F., a catalyst-to-oil ratio of from 5 to 10, and residence time of from 1 to 4 seconds and where coke is deposited on said catalyst in an amount less than 1.2 weight percent thereof, to obtain vaporous conversion products of the first hydrocarbon feed comprising a heavy naphtha fraction and materials lower boiling than said heavy naphtha fraction, a light cycle oil, a heavy cycle oil, and materials higher boiling than said heavy cycle oil, while simultaneously (b) cracking a second hydrocarbon feed comprising virgin naphtha, intermediate and heavy cracked naphtha boiling range material or mixtures thereof, having a boiling point to about 450° F., in a second elongated riser reactor in the presence of regenerated cracking catalyst supplied from the second catalyst regeneration zone at a temperature of at least 1300° F., a catalyst-to-oil ratio of from 3 to 12, and residence time of from 1 to 5 seconds, and where coke is deposited on said catalyst in an amount less than 0.5 weight percent thereof, to obtain vaporous conversion products of the second hydrocarbon feed comprising gasoline boiling range material having a high aromatic content and octane number and lighter hydrocarbon material from a light cycle oil material, and (c) combining the vaporous conversion products from the first and second elongated riser reactors in a common disengaging zone therein separating entrained catalyst particles from vaporous product material and passing the combined conversion products to a fractional distillation zone to recover at least a gasoline boiling range material fraction and lighter gaseous hydrocarbon material fraction, a light cycle oil boiling range material fraction and a heavy naphtha boiling range material fraction including slurry oil and higher boiling material fractions.

2. The method as defined in claim 1 wherein at least a portion of the gasoline or heavy naphtha fraction or mixtures thereof is recycled and recracked in the second riser reactor or the first riser reactor or both first and second riser reactors.

3. The method as defined in claim 2 wherein the gasoline or heavy naphtha fraction or a mixture of both is recracked in the presence of the virgin naphtha to improve its octane rating and aromatic content.

4. The method of claim 1 wherein the first hydrocarbon feed comprises heavy hydrocarbon feedstocks having a Conradson carbon of at least 2 weight percent and boiling initially at least 400° F. with about 20 weight percent or more of components therein boiling at about 1000° F. or above, and the second hydrocarbon feed comprises virgin naphtha boiling in the ranged from 10° F. to 392° F., and intermediate or heavy naphtha containing components or a mixture thereof boiling up to about 450° F.

5. In a fluidized catalytic cracking-regeneration process for cracking hydrocarbon feedstocks or the vapor thereof with finely-divided cracking catalyst in a fluidized state to produce cracked products and spent catalyst particles having hydrocarbonaceous deposits thereon, stripping vaporous hydrocarbon products from the catalyst particles, transferring the fouled catalyst to a first regeneration zone wherein the catalyst is partly regenerated by combusting substantially all the hydrocarbon associated with the hydrocarbonaceous deposits on the catalyst at temperatures of less than about 1300° F. in the presence of oxygen-containing gas at pressures ranging from about 15 to about 40 psig and in amounts effective to produce a first regeneration zone flue gas having a carbon monoxide content from about 2 to about 80 volume percent, then transferring the partly regenerated catalyst to a second regeneration zone wherein the catalyst is fully regenerated by combusting substantially all the hydrocarbonaceous deposits remaining on the catalyst surface at temperatures ranging from about 1300° F. to about 1800° F. in the presence of oxygen-containing gas in amounts effective to produce a second regeneration zone flue gas having a carbon monoxide content of less than about 1200 parts per million by volume, wherein the improvement consists of:

(a) cracking a first hydrocarbon feed comprising gas oil, residual oil boiling range material or a mixture thereof in a first elongated riser reactor in the presence of regenerated cracking catalyst supplied from the second catalyst regeneration zone at a temperature of at least 1300° F., a catalyst-to-oil ratio of from 5 to 10, and residence time of from 1 to 4 seconds and where coke is deposited on said catalyst in an amount less than 1.2 weight percent thereof, to obtain vaporous conversion products of the first hydrocarbon feed comprising a heavy naphtha fraction and materials lower boiling than said heavy naphtha fraction, a light cycle oil, a heavy cycle oil, and materials higher boiling than said heavy cycle oil, while simultaneously (b) cracking a second hydrocarbon feed comprising virgin naphtha, intermediate cracked naphtha or heavy cracked naphtha, or a mixtures thereof, boiling range material, having a boiling point to about 450° F., in a second elongated riser reactor in the presence of regenerated cracking catalyst supplied from the second catalyst regeneration zone at a temperature of at least 1300° F., a catalyst-to-oil ratio of from 3 to 12, and residence time of from 1 to 5 seconds, and where coke is deposited on said catalyst in an amount less than 0.4 weight percent thereof, to obtain vaporous conversion products of the second hydrocarbon feed comprising gasoline boiling range material having a high aromatic content and octane number and lighter hydrocarbon material from a light cycle oil material, and (c) combining the vaporous conversion products from the first and second elongated riser reactors in a common disengaging zone therein separating entrained catalyst particles from vaporous product material and passing the combined conversion products to a fractional distillation zone to recover at least a gasoline boiling range material fraction and lighter gaseous hydrocarbon material fraction, a heavy naphtha boiling range material fraction, a light cycle oil boiling range material fraction and a heavy naphtha boiling range material including slurry oil and higher boiling material fractions.

* * * * *

UNITED STATES PATENT AND TRADEMARK OFFICE

CERTIFICATE OF CORRECTION

PATENT NO. : 5,009,769

DATED : April 23, 1991

INVENTOR(S) : Alan R. Goelzer

It is certified that error appears in the above-identified patent and that said Letters Patent is hereby corrected as shown below:

Column 16;

In Claim 4, line 11, "ranged" should read --range--.

In Claim 5, line 58, "mixtures" should read -- mixture--.

In Claim 5, line 6 (column 18), "naphtha" should read --cycle--.

Signed and Sealed this

Tenth Day of November, 1992

*Attest:*

DOUGLAS B. COMER

*Attesting Officer*

*Acting Commissioner of Patents and Trademarks*